United States Patent [19]

Devroe

[11] 3,966,043

[45] June 29, 1976

[54] PACKAGE FOR FLORAL ART PIECES

[75] Inventor: Leo Guillaume Devroe, Edegem, Belgium

[73] Assignee: Antwerp Plastic Merchandising, Antwerp, Belgium

[22] Filed: July 22, 1974

[21] Appl. No.: 490,245

[30] Foreign Application Priority Data

Apr. 30, 1974 Belgium ..... 53581

[52] U.S. Cl. ..... 206/423; 47/34.11; 206/45.14

[51] Int. Cl.[2] ..... B65D 25/10; B65D 85/52

[58] Field of Search ..... 206/423, 45.14, 523; 47/34.11

[56] References Cited

UNITED STATES PATENTS

| | | | |
|---|---|---|---|
| 603,649 | 5/1898 | Leedy | 206/423 X |
| 1,159,338 | 11/1915 | Potter | 47/34.11 |
| 2,736,138 | 2/1956 | Buttery | 47/34.11 |
| 3,251,460 | 5/1966 | Edmonds | 206/523 |
| 3,372,795 | 3/1968 | Logan et al. | 206/523 |
| 3,576,253 | 4/1971 | Keats et al. | 206/45.14 |

*Primary Examiner*—Leonard Summer
*Attorney, Agent, or Firm*—Bacon & Thomas

[57] ABSTRACT

A package for a pot containing a floral art piece comprising an open box having a back wall, two side walls, a top wall and a bottom wall, said side walls having inwardly directed opposed flange-like members having spaced apart inner edges and dividing said box into a lower compartment for said pot and an upper compartment for the floral art piece. The spaced edges and the portions of the side walls below the members converge from the front of the package toward the back wall and at least one of the bottom wall and lower surfaces of the members sloping toward the back wall, whereby the height of the lower compartment adjacent the back wall is less than that at the front of the package.

1 Claim, 11 Drawing Figures

PACKAGE FOR FLORAL ART PIECES

The present invention relates to a package for foral art pieces, especially for floral art pieces with flowers made from plastics.

The present invention relates even more especially to packages for floral art pieces comprising a support, e.g. a little pot, a cup or plate, a water well, a swan, a wheelbarrow, a fountain, an angel, a basket and the like, wherein flowers and, possibly, flowering and/or other ornamental plants may be arranged. For this purpose, the flowers and possibly the plants are generally stuck in the material located in the support. This material is usually clay or a similar elastic or spongious material.

Although packing floral art pieces containing true flowers and plants does not make really much of a problem, because of the persons concerned usually taking over the goods individually, it is, however, possible that suchlike floral art pieces have to be sent away by truck, railways or similar means of transport.

When the goods to be transported are floral art pieces made from plastics, which are generally mass production goods, it often occurs that they must be sent away by truck, railway, even by ship. Until now the said floral art pieces were packed in a simple box, the open side of which was closed by a transparent screen.

Although this packing method has been fully satisfactory as long as floral art pieces were handled with normal care, this kind of shipment has always turned out to be a fiasco whenever a number of packs happened to all over on their sides or to be turned upside down inside the means of transport.

As a matter of fact, after a few dozens of meters the top part of the piece, say the plant or flowers, becomes crushed because the heaviest, that is to say the support with clay or a similar material, compresses the plant or flowers.

Therefore, the object of the present invention is to achieve a package which entirely prevents damage to such floral art pieces, even should they be placed upside down for the full duration of the transport.

In this way there is achieved not only that less attention is required when piling up and taking in stock such floral art pieces, but that pieces becoming damaging by putting packs upside down or putting same on their sides is totally excluded.

For this purpose, the package according to the invention comprises an open box a back wall, two sides walls, a top wall and a bottom wall, said side walls having inwardly directed opposed flange-like members having spaced apart inner edges and dividing said box into a lower compartment for said pot and an upper compartment for the floral art piece. The spaced edges and the portions of the side walls below the members converge from the front of the package toward the back wall and at least one of the bottom wall and lower surfaces of the members sloping toward the back wall, whereby the height of the lower compartment adjacent the back wall is less than that at the front of the package.

In order that the invention may be better understood, a few preferred embodiments of the invention will be explained hereafter, as mere examples, without any limiting character and with reference to the following drawings of which:

Figure 1:
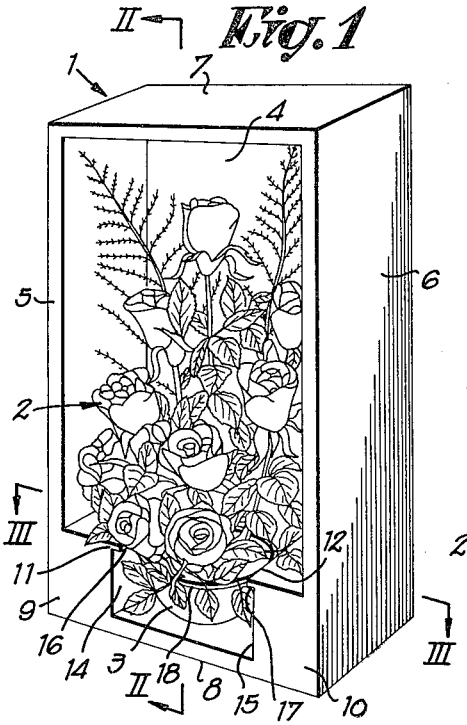
FIG. 1 shows a perspective view of a floral art piece, which is placed in a package according to the invention.

The FIGS. 1 through 6 show a package 1 according to the invention, which is for the purpose of transporting a floral art piece 2 in an appropriate way.

The floral art piece 2 is fixed, in a known manner, by means of clay or similar material, in a support, in this case a pot or cup 3.

The package 1 proper of this embodiment consists of a box with back wall 4, side walls 5–6, a top wall 7 and a bottom wall 8, and in this case the side walls show thicker parts 9 and 10 in the lower part of the package, the said thicker parts having, at the top, protruding flange-like edges, 11 and 12 respectively, facing one another. In this case, those protruding parts or edges 11–12 are connected at the back side, that is to say adjacent to the back wall 4, by means of a protruding flange-like edge 13 facing the front of the package.

Figure 3:
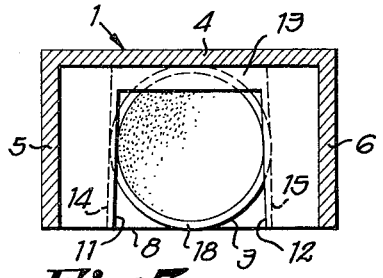
Figure 6:
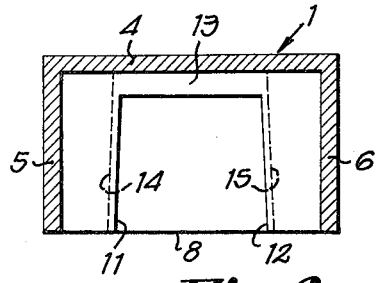

The inside faces, 14 and 15 respectively, of the thicker parts 9 and 10, preferably run obliquely, as clearly shown by FIGS. 3 and 6, the edges 11 and 12 also running obliquely, that is to say being parallel to the planes of 14 and 15.

The bottom faces, 16 and 17, of the edges 11 and 12 shall also preferably be oblique, that is to say the height of the bottom face shall be higher at the front of the package than at the rear.

Figure 2:
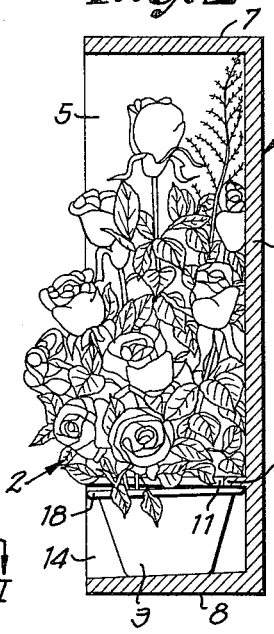
FIGS. 2 and 3, show sections along the lines II—II and III—III of FIG. 1, respectively.
Figure 5:
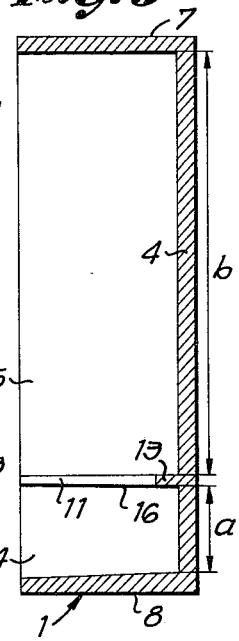
FIGS. 5 and 6 show sections along the lines V—V and VI—VI of FIG. 4.
Figure 4:
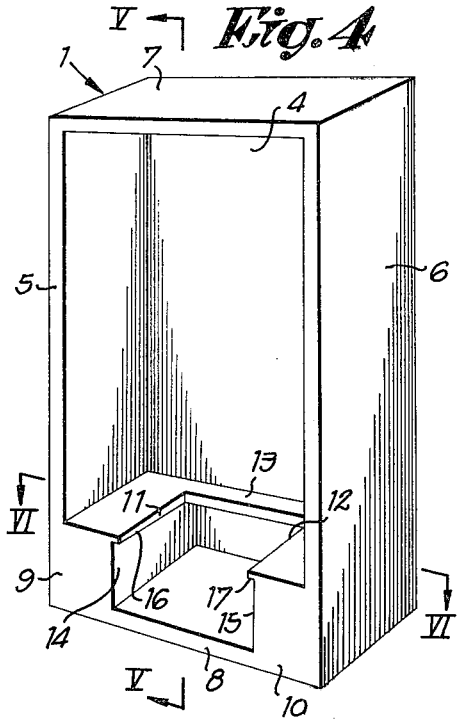
FIG. 4 shows a perspective view of the package according to the invention.

Finally, the inside face of the said bottom wall 8 shall also be olbique, that is to say sloping, it being lowest at the front of the package, as may be seen referring to FIGS. 2 and 5.

The dpeth of the package will depend, on the one hand, on the size of the cup 3 and, on the other hand, on the size of the floral art piece proper, whilst the distance *a* will depend on the height of the cup 3 and distance *b* on the height of the floral art piece.

The floral art piece 2 with the cup 3 may be put in the appropriate package 1 by sliding the cup 3 under the edges 11–12 and 13, as may be seen from FIGS. 1, 2 and 3.

As the package fits the floral art piece, on the one hand, and the cup 3, on the other hand, this sliding-in-place action results in the bottom of the cup being clamped against the sloping inner face of the bottom wall 8, whilst, at the same time, the upper edge of the cup becomes clamped under the oblique edges 11 and 12, and also at the same time the protruding part of the cup, or the part of same with the largest dimension, in this case the edge 18, becomes clamped between the oblique walls 14 and 15.

It is clear that this package means results in the floral art piece 2 being suitably kept in place in the package 1, because of the cup 3 being clamped vertically and transversely.

Such package 1 will preferably be made from a slightly elastic material, so that when the cup 3 is put into the package, the material is slightly compressed, which will achieve an additional clamping of the cup.

In this way there is achieved that the floral art piece 2, respectively the cup 3, is anchored so to say in the package, in such a way that putting the package on its side or even placing it upside down can have no deteriorating effect on the floral art piece, this remaining suspended by means of the cup 3 which, on the one hand, is clamped and, on the other hand, rests on the said edges 11, 12 and 13.

Figure 7:
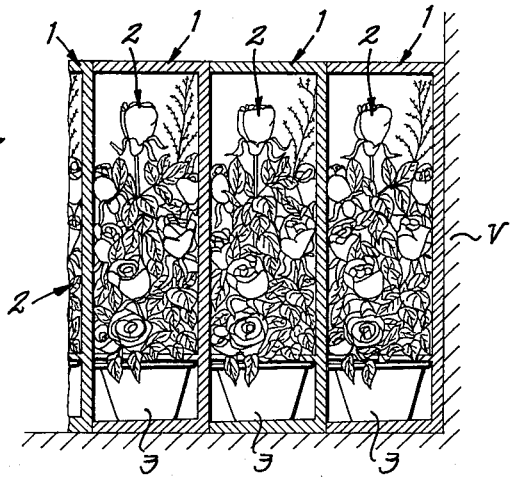
FIG. 7 shows a part of a shipment in which packages according to the invention are placed the one next to the other and FIGS. 8, 9, 10 and 11 show variants of the package concerning the lower part of same in accordance with supports having different shapes.

FIG. 7 shows that packages of the kind described may be placed in an appropriate common package, case, crate, container or similar means, parts of the floral art piece, which slightly protrude from the front of the package being simply compressed, it being apparent that when being unpacked, they will take their original place once more because they are elastic. In this way there is achieved that the transport of such floral art pieces may be carried out without drawbacks whatsoever, even should the packages be put upside down by mistake.

It must be clear that packages of the kind may be manufactured using a suitable selection of the aforesaid oblique parts in relation to the dimensions of the cups 3, so as to be suitable for use with a specific series of cups. Generally speaking, however, a package of this kind will be made so as to suit the shape of the cup 3.

Figure 8:
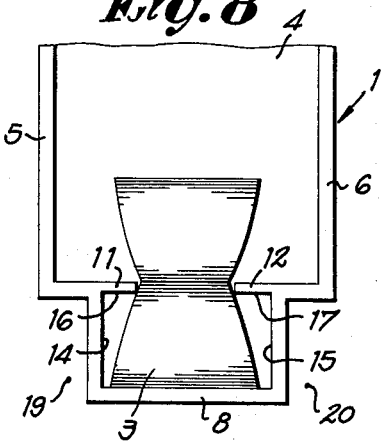
Figure 9:
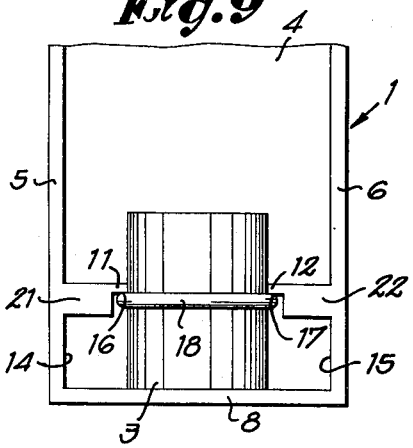

The FIGS. 8 through 11 show examples of packages adapted to several cup shapes. In the package of FIG. 8 less material is used than in the package of FIGS. 1 through 6. In FIG. 9 material is saved as the thicker parts 9 and 10 have been left out and in this case the edges 11 and 12 are connected with the side walls, 5 and 6 of the package by means of parts 21 and 22 which are thicker.

Figure 10:
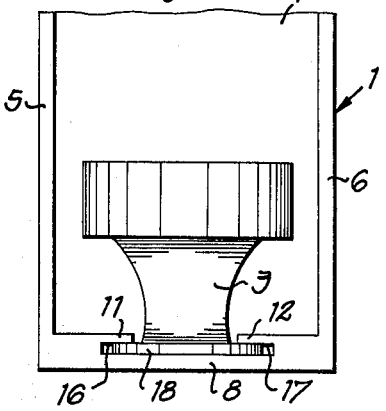
Figure 11:
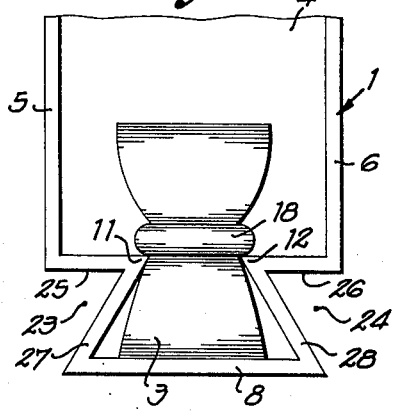

FIG. 10 shows an embodiment in which the said edges 11 and 12 are located at the bottom of the package so as to engage the flange-shaped foot 18 of the cup or pot. In FIG. 11 an embodiment has been shown in which material has also been saved as shown at 23 and 24, the edges 11 and 12 resulting from a suitable design of the walls of the box itself. As a matter of fact, in this case the walls 5 and 6 are connected with the bottom wall 8 by means of horizontal walls, 25–26 respectively, and sloping connection walls between the latter and bottom wall 8, 27–28 respectively.

It is clear that other shapes may be adopted, depending on the shape and dimensions of the cups, pots and similar objects.

It is also clear that the aforesaid cups or pots may be clamped in position in a package of the kind in question, e.g. through designing the said edges 11–12 and, possibly, 13 and making them oblique as well as through providing for a sloping upper face of the bottom wall, but it is also possible to design the edges 11 and 12 only and to keep same horizontal as well as the top face of the bottom wall 8, so that only falling down of the cup or pot 3 is prevented should it occur that the package be turned upside down.

It is also possible that the walls 14 and 15 are made parallel to the walls 5 and 6, the latter being also parallel to each other. Thus it is clear that the package according to the invention may be achieved in various ways and shapes, and with various dimensions, without falling outside the scope of the invention.

What I claim is:

1. A package for a support having a peripheral edge and an article projecting from said support, such as a pot containing a floral art piece, comprising:

a unitary open box having a back wall, two side walls, a top wall and a bottom wall, said side walls having inwardly directed opposed flange-like members having spaced apart inner edges and dividing said box into a lower compartment for said support and an upper compartment for said article, said spaced edges and the inner surfaces of the portions of said side walls below said members converging from the front of said package toward said back wall and at least one of the inner surface of said bottom wall and lower surfaces of said members sloping toward said back wall whereby the height of said lower compartment adjacent said back wall is less than that at the front of the package, said support being positioned in said lower compartment and at least a portion thereof wedgingly received between said botttom wall and the lower surfaces of said members, and a further flange-like member extending forwardly from said back wall and connecting the rear portions of said spaced inner edges.

* * * * *